United States Patent [19]

Rogalski et al.

[11] Patent Number: 4,945,667

[45] Date of Patent: Aug. 7, 1990

[54] SIMULATED SIGHTING DEVICE

[76] Inventors: Curtis J. Rogalski, 815 W. Beardsley Rd., Phoenix, Ariz. 85027; Rudolph S. Rogalski, 2346 E. Sylvia, Phoenix, Ariz. 85022

[21] Appl. No.: 209,174

[22] Filed: Jun. 20, 1988

[51] Int. Cl.[5] ..... F41G 1/42

[52] U.S. Cl. ..... 42/100; 42/103; 33/241

[58] Field of Search ..... 42/100, 103; 33/233, 33/234, 241, 244

[56] References Cited

U.S. PATENT DOCUMENTS

| | | | |
|---|---|---|---|
| 1,256,987 | 2/1918 | Dittemore | 33/241 |
| 2,925,657 | 2/1960 | Stenby | 33/241 |
| 2,969,594 | 1/1961 | Palmer | 33/241 |
| 3,098,303 | 7/1963 | Plisk | 33/241 |
| 3,700,339 | 10/1972 | Steck, III | 33/241 |
| 3,813,790 | 6/1974 | Kaltmann | 33/241 |
| 3,949,482 | 4/1976 | Ross | 33/241 |
| 3,974,585 | 8/1976 | Dunham | 42/100 |
| 4,070,763 | 1/1978 | Carts, Jr. | 42/100 |
| 4,494,327 | 1/1985 | Cullity | 42/100 |

*Primary Examiner*—Charles T. Jordan
*Assistant Examiner*—Michael J. Carone
*Attorney, Agent, or Firm*—Cahill, Sutton & Thomas

[57] ABSTRACT

A simulated sighting device aligned with an axis of interest of an attached element, such as a firearm, provides a visually superimposed lighted indication commensurate with the proximity to alignment of the attached element with a target. Baffles and an aperture, both of limited height and width, define a beam of light from a light source coincident with a predetermined axis. Upon visual superimposition of the viewed light source upon a target, the predetermined axis of the sighting device and axis of interest of the attached element are aligned with the target.

8 Claims, 2 Drawing Sheets

SIMULATED SIGHTING DEVICE

BACKGROUND OF THE INVENTION

1. Field of the Invention

The present invention relates to sighting devices and, more particularly, to simulated sighting devices for use in low light environments.

2. Description of the Prior Art

Common sighting devices for use with firearms, whether long or short barreled, include a front sight usually formed by a bead located at the muzzle of the barrel and at a point 1/16th to ¼th of an inch above the barrel. An alternative front sight is a blade sight. A rear sight is disposed in proximity to the breech of the gun and includes a V-shaPed groove or a slot. The bead or blade is usually positionally fixed and the rear sight is movable vertically to accommodate for elevation correction commensurate with the distance to the target and horizontally to accommodate for windage or misalignment of the bore. In some configurations, the rear sight may be a circular aperture.

Under low light conditions, it may be nearly impossible to view the front sight sufficiently well to superimpose it upon a target. Without such visual superimposition, accurate shooting becomes very difficult. Only those few individuals who are sufficiently experienced to have a feel for the position of the gun with regard to the target can hope to hit the target.

In an effort to develop apparatus for accurate shooting in low light conditions approaching near darkness, various devices have been developed. Scope like devices having large diameter optics have been developed in an effort to gather sufficient of the ambient light to make the target visible. These devices generally attach to the gun to serve as a sighting element in place of the more conventional front and rear sights. More sophisticated devices have been developed for gathering any existing light reflected from a target and, through electronic means, enhance the image. While relatively effective, these optical light gathering devices and electronic light enhancing devices are relatively expensive; moreover, they are usually too bulky to be used with hand guns.

Because of the expense and bulk of sophisticated light gathering devices, visibility of the front sight has been sought to be improved by painting it white or by using a dab of phosphorescent paint. The latter, to be self-illuminating must have been exposed to light in order to stimulate light emission. Should such firearms be normally retained within scabbards or holsters, sufficient stimulation of the phosphorescent paint may not have occurred prior to use.

SUMMARY OF THE INVENTION

A simulated sighting device includes a light source and baffles for developing a beam of light and for limiting visual access to the light source through a small aperture and along a predetermined axis coincident with the beam of light. Alignment of the predetermined axis of the simulated sighting device with ones line of sight will come about upon viewing the light source. By superimposing the viewed light source upon a target, the predetermined axis of the simulated sighting device will be aligned with the line of sight to the target. Accordingly, an element, such as a firearm, to which is attached the simulated sighting device can be aligned with the line of sight to the target and the alignment will be available under lighting conditions which are just sufficient to illuminate the target. Aside from firearms, other areas of application of the simulated sighting device include archery, surveying, etc.

It is, therefore, a primary object of the present invention to provide a simulated sighting device for use under low light conditions.

Another object of the present invention is to provide a simulated sighting device for use with firearms.

Yet another object of the present invention is to provide a simulated sighting device for aligning an attached element with a visually perceivable target.

A further object of the present invention is to provide a small sized self-contained simulated sighting device having a light source.

A yet further object of the present invention is to provide a method for aiming firearms under low light conditions.

A still further object of the present invention is to provide a method for aligning an element with a target under low light conditions.

A still further object of the present invention is to provide an inexpensive simulated sighting device.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
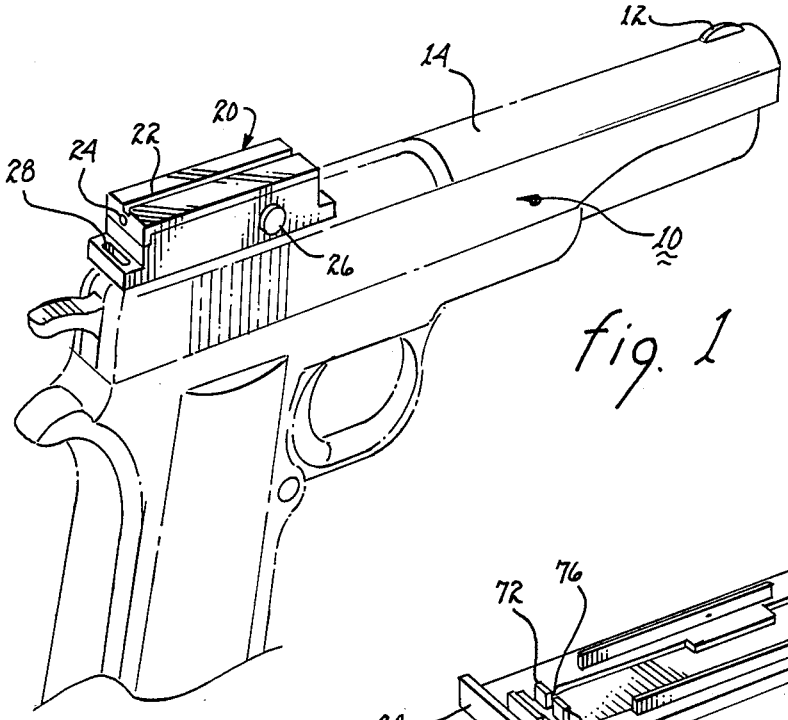
FIG. 1 illustrates a hand gun having the simulated sighting device mounted thereon.

Referring to FIG. 1, there is illustrated in representative form a conventional hand gun 10. The particular hand gun depicted is sometimes referred to as a semi-automatic pistol. The conventional configuration of such a hand gun includes a bead or, as depicted, a blade 12 disposed at the muzzle end of a slide 14 which blade serves the function of a front sight. A V-shaped groove or slot (not shown) is usually located toward to the rear of the hand gun or at the breech to serve as the rear sight. The rear sight is generally adjustable in elevation and azimuth. To aim the hand gun on a target, the hand gun is located such that blade 12 exactly fills the "V" groove or slot of the rear sight in superimposed relationship with the target. Upon firing the hand gun when the sights are so aligned, the projectile will strike the target at the aim point. To counter windage, distance or misalignment of the bore and other variants, the rear sight may have to be adjusted in azimuth and/or elevation. This type of sighting system has been in use for many, many years and works very well provided sufficient light exists to clearly view the front and rear sights as well as the target. Under low light conditions just sufficient to see a target but insufficient to clearly align the sights therewith, accurate aiming of the hand gun or other firearm becomes more a matter of "feel" than optical aiming. Depending upon the skill and experience of a user, the accuracy with which a projectile will hit the target will vary substantially.

To unequivocally align the sights of a firearm with a target, it is necessary to have some type of illuminated or lighted sights. Alternatively, extremely expensive optical and/or electronic light gathering devices may be employed. The latter are generally not available to the majority of firearm users because of price; moreover, they are bulky and require substantial care and maintenance.

Simulated sighting device 20, illustrated as attached to hand gun 10 in FIG. 1, was developed to provide the capability of aiming a firearm under low light conditions. This device may be attached to the hand gun at the location depicted. Alternatively, it may be relocated to another position, depending upon the structure of a particular make and model of hand gun. The simulated sighting device may just as easily be used with any other type of firearm, whether a rifle, shotgun, revolver, etc. Necessarily, some accommodation must be made to secure the simulated sighting device to the anchor points presently used with a rear sight or to other anchor points that may exist or which may have to be added. It is preferable that the simulated sighting device be adjustable to accommodate for azimuth and elevation in the manner a conventional rear sight is adjustable.

Simulated sighting device 20 may include an axially aligned groove 22 for purposes of bore sighting the device to provide convergence at a fixed distance between the axis of the bore of the firearm with the line of sight axis of the simulated sighting device. Obviously, groove 22 may be used for gross aiming of the firearm.

The simulated sighting device includes an internal battery operated source of light. This light is viewable through a rear wall located aperture 24. To preserve the battery, a button 26 may be incorporated for the purpose of energizing the internally mounted light for a predetermined duration. Such limited energization of the light will tend to conserve the battery during non-use yet, the device may be left in the "on" position for the duration of use of the firearm. In one embodiment, a timer, such as a 555 IC or its improved version, XR-L555 IC, may be employed to work as a one shot or monostable circuit. Means, such as slot 28, or the like, may be disposed at opposed ends of simulated sighting device 20 for securing and/or adjusting the alignment of the device with respect to the bore of the firearm. As generally depicted in FIG. 1, the height of aperture 24 is very close to and intended to be commensurate with the height of the "V" or slot in a conventional rear sight for a firearm.

Figure 2:
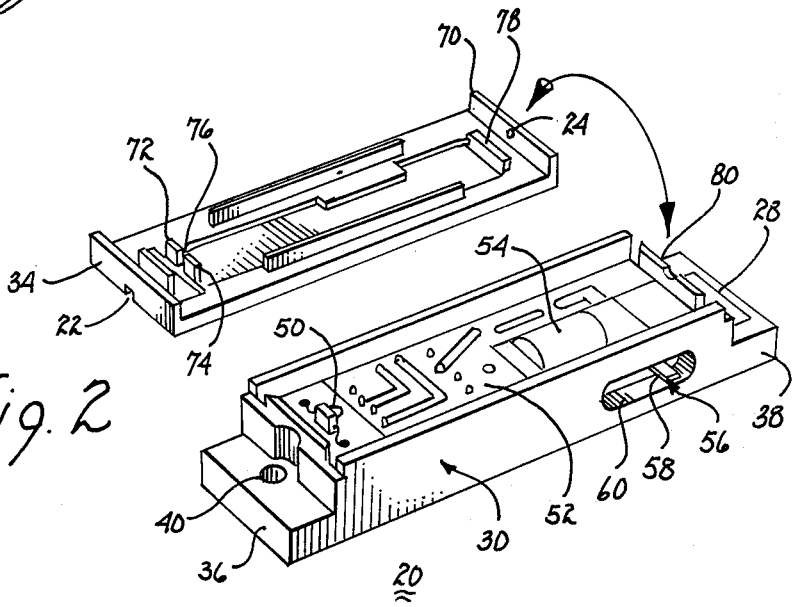
FIG. 2 illustrates the major subassemblies of the simulated sighting device.

Referring to FIG. 2, there are illustrated the two major components of the case 30 of simulated sighting device 20. The case includes a base member 32 and a cover member 34. Flanges 36, 38 may extend longitudinally from base member 32 to provide for a hole 40 or slot 28 disposed therein to facilitate mounting of the device upon a firearm or other point of use device. Alternatively, adjustment devices for elevation and azimuth may be associated with such aperture or slot.

A source of light 50 is mounted within base member 32. Control for energizing and deenergizing the source of light may be provided by a circuit developed upon a printed circuit board (PC board) 52, which PC board is lodged within the base member. At a convenient location, a battery 54 of suitable size and electrical capacity may be located and electrically connected to PC board 52. A conventional slide switch or other switch 56 may be incorporated to connect and disconnect battery 54 from the circuit. As depicted, toggle 58 of switch 56 may be disposed within a protective slot 60 formed within a side of base member 32. Cover member 34 may include groove 22 formed therein, as depicted in FIG. 1. Aperture 24 is formed within a downwardly extending edge 70 at approximately the mid-point across the cover member. A pair of light guards 72, 74 are located proximate the opposing end of the cover member from aperture 24 and spaced apart from one another to define a slot 76 therebetween. Light source 50 is generally laterally centered within base member 32. Similarly, slot 76 and aperture 24 of the cover member are laterally centrally located. An imaginary line interconnecting these three elements would be parallel with the longitudinal axis of the simulated sighting device and with groove 22 and define the predetermined axis.

Because simulated sighting device is intended to be used in low light conditions, it is important that no light escape from the device which might desensitize a user's eyes. Under certain circumstances, it may also be mandatory that the presence of a simulated sighting device, the attached firearm or the user not be made evident by any visible source of light. To prevent emanation of light from within case 30, base member 32 and cover member 34 include a plurality of interlocking keying elements to not only rigidly secure the cover member to the base member but to prevent radiation of the light from within the simulated sighting device at any location other than through aperture 24.

Figure 3:
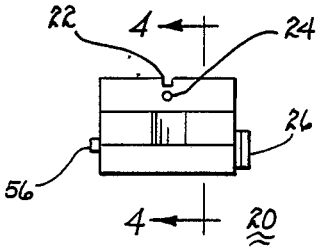
FIG. 3 is a user's end view of the simulated sighting device.
Figure 4:
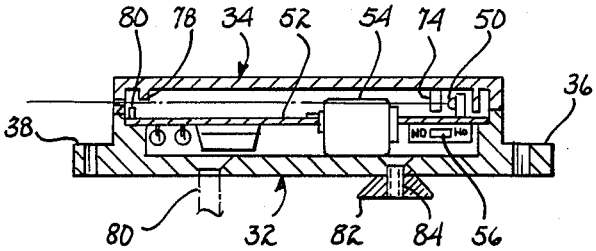
FIG. 4 is a cross-sectional view taken alone lines 4—4, as shown in FIG. 3.

FIG. 3 depicts a view of the simulated sighting device as would be seen by a user. The on/off switch 56 would first be turned on and when a user wished to illuminate the source of light within the device, push button 26 would be actuated. By looking into aperture 24 with one eye from a location aligned with the predetermined axis, the user would be able to see light radiating from light source 50 within the device. The light visible to a user constitutes a beam of light limited in width by the width of slot 76 developed by guards 72, 74 (see FIG. 2). Moreover, the vertical dimension of the beam may limited by a baffle 78 extending downwardly from cover member 34 and a baffle 80 extending upwardly from base member 32.

Attachment of simulated sighting device 20 to a firearm may be by means of a tenon 82 secured to base member 32 by means of a threaded bolt 84 or the like. Such tenon would be configured and dimensioned similar to a tenon that might be attached to a rear sight for the particular firearm to which the simulated sighting device is to be attached. Other mechanisms unique to the respective firearm could also be secured to base member 32; bolt 86, depicted in dashed lines, is representative of such attachment means.

Figure 5:
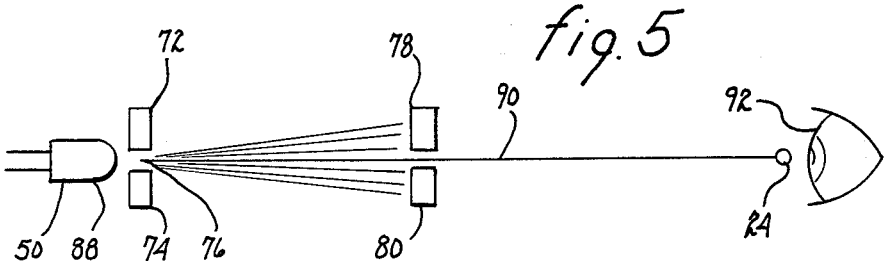
FIG. 5 is a pictorial representation of use of one embodiment of the invention.

FIG. 5 is a pictorial illustration of the operation of simulated sighting device 20. Light source 50, which may be a direct light source, such as a light bulb 88, as depicted, is located generally adjacent guards 72, 74 defining slot 76 therebetween. The beam of light radiated past slot 76 is reduced in height by baffles 78, 80 (whereby essentially only a narrow beam of light 90 impinges upon aperture 24. To a greater or lesser extent, aperture 24 may further constrict the light viewable by a user, depicted by representation 92 of an eye.

Figure 6:
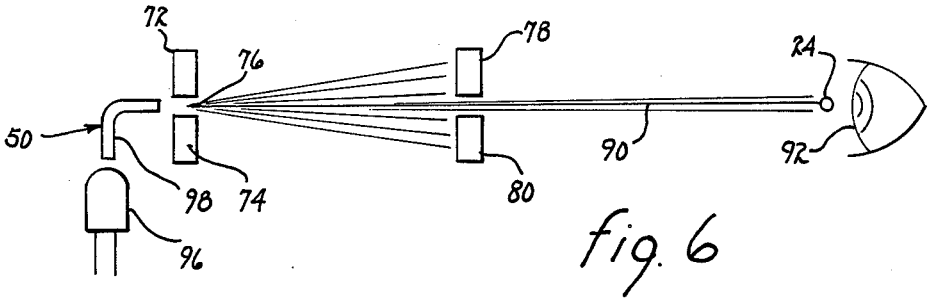
FIG. 6 is a pictorial representation of use of another embodiment of the present invention.

A variant of the light source is depicted in the pictorial illustration represented in FIG. 6. Herein, light source 50 includes a light bulb or lamp 96 located at a point remote from slot 76 and not in alignment with light beam 90. A length of fiber optic material 98, or the like, may be employed to convey light from lamp 96 to a point coincident with slot 76. The light radiating from the end of fiber optic 98 will serve the same function as lamp 88 shown in FIG. 5. Furthermore, the possibility of a remote location for lamp 96 permits better and more compact packaging of components within case 30. Under certain conditions of use, the plan form of the light emitting surface attendant fiber optic 98 may be uniquely configured for a particular or specialized purpose of use of the simulated sighting device.

Figure 7:
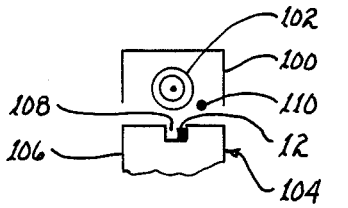
FIGS. 7, 8, 9 and 10 correlate the images seen by use of a conventional gun sight with that of the present invention for various off and on target situations.
Figure 7:
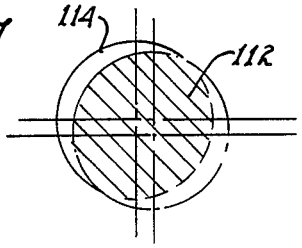

FIGS. 7, 8, 9 and 10 illustrate the correlation between conventional sights of a firearm with simulated sighting device 20 under various states of aim of a firearm. In particular, FIG. 7 illustrates a target 100 having a bullseye 102. Sights 104 include a rear sight 106 having a slot 108 cooperating with blade 12 of a front sight. As depicted, blade 12 is slightly below the top of rear sight 106 and to the right of center of slot 108. Were the firearm fired, the projectile would strike the target at point 110 below and to the right of bullseye 102. The image viewable through simulated sighting device 20 would be a portion of a lighted circle 112 having an arcuate sliver 114 removed from the upper left quadrant thereof.

Figure 8:
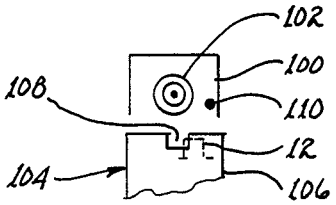
Figure 8:
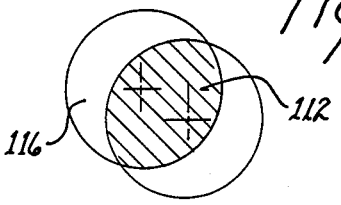

In FIG. 8, there is illustrated a condition under which blade 12 is slightly below the top of rear sight 106 but barely visible along the right edge of slot 108. Were the firearm to be fired, the projectile would strike target 100 at point 110, substantially to the right of and slightly below center of bullseye 102. The image which would be visible to a similarly aimed simulated sighting device 20 would depict a portion of a lighted circle 112 having a substantial arcuate portion removed from the upper left of the circle.

Figure 9:
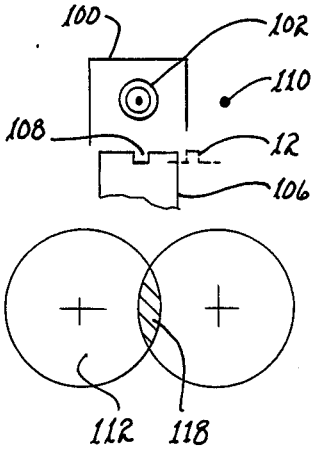

FIG. 9 depicts a situation wherein blade 12 is correctly positioned in elevation but substantially moved to the right from slot 108 of rear sight 106. Were the firearm to be fired, the projectile or point of impact would be at point 110 substantially to the right of bullseye 102 but horizontally aligned therewith. The image which would be viewed through simulated sighting device 20 would be a vertically aligned double curved segment 118 of a circle 112.

Figure 10:
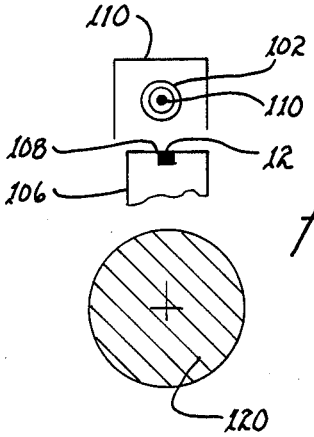

Upon proper positioning of blade 12 within slot 108, as shown in FIG. 10, a projectile fired from a firearm would strike point 110 at the center of bullseye 102. The simulated sighting device would provide a representation of a complete lighted disc 120.

During aiming of a firearm, most experienced shooters have both eyes open. For conventional right handed shooting, the right eye is positioned in alignment with the sights of a firearm. The left eye is maintained open and is usually focused upon the target. Some users of firearms have conditioned their brain to superimpose the images viewed by each eye; other users have conditioned their brain to disregard the image seen by the left eye. With the present invention, it is apparent that the target cannot be viewed through the simulated sighting device. Since it is mandatory that the target be viewed prior to use of the device, assuming it is mounted upon a firearm, the image of the target must be established by the left eye if the right eye is used in conjunction with the simulated sighting device. In actual operation, the firearm would be oriented in such manner that an image of an illuminated circle seen through aperture 24 of the simulated sighting device would be seen by the right eye The left eye would be focused upon the target. By having the user's brain superimpose the image of the right eye with that of the left eye, it will become immediately apparent how close to the target the image of the illuminated circle was. If it were off target, the firearm would have to be moved until the lighted circle appeared to be superimposed upon the target. Upon such occurrence, the firearm, if discharged, would be accurately aimed and the discharged projectile would strike the target.

From the above description of the actual operation of the present invention, it will become apparent that it may have uses in a number of fields of endeavor wherein a known image may be superimposed upon a further image to establish a predeterminable relationship.

While the principles of the invention have now been made clear in the illustrated embodiments, there will be immediately obvious to those skilled in the art, many modifications of structures, arrangements, proportions, elements, materials and components used in the practice of the invention and otherwise, which are particularly adapted for specific environments and operational requirements without departing from those principles. The appended claims are therefore intended to cover and embrace any such modifications within the limits only of the true spirit and scope of the invention.

We claim:

1. A simulated sighting device for viewing on end a beam of light to assist in orienting an apparatus with a target, said device comprising in combination:

(a) a case, said case including a base member and a cover member;

(b) a source of visible light, said light source being disposed within said base member;

(c) means disposed within said case for channeling a beam of light from and in alignment with said light source along a predetermined axis of said case, said channeling means including baffles for defining the beam of light;

(d) an aperture disposed in said case, said aperture being aligned with the viewed beam of light for viewing on end the beam of light upon orientation of said device to locate the predetermined axis in alignment with an eye of the viewer; and (e) means for attaching said device to the apparatus in a predetermined positional relationship; whereby, the apparatus will be oriented with the target in a predetermined relationship upon visual superimposition of the viewed beam of light with the target.

2. A simulated sighting device for viewing on end a beam of light to assist in orienting an apparatus with a target, said device comprising in combination:

(a) a case, said case including an end wall;

(b) a source for producing a visible light, said light source being disposed within said case;

(c) means disposed within said case for channeling a beam of light from and in alignment with said light source along a predetermined axis of said case;

(d) an aperture disposed in said end wall of said case, said aperture being aligned with the viewed beam of light for viewing the beam of light upon orientation of said device to locate the predetermined axis in alignment with an eye of the viewer; and (e) means for attaching said device to the apparatus in a predetermined positional relationship; whereby, the apparatus will be oriented with the target in a predetermined relationship upon visual superimposition of the viewed beam of light with the target.

3. A simulated sighting device as claimed in claim 2 wherein said light source is disposed at a distance from said end wall.

4. A simulated sighting device as claimed in claim 3 including a plurality of baffles disposed within said case for defining the beam of light between said light source and said aperture.

5. A simulated sighting device as claimed in claim 4 wherein said light source comprises a lamp.

6. A simulated sighting device as claimed in claim 5 wherein said channeling means includes light transmissive means for directing light from said lamp to the axis of the viewed beam of light.

7. A simulated sighting device as claimed in claim 4 including means for selectively energizing and deenergizing said light source.

8. A simulated sighting device as claimed in claim 4 including means for preventing light from emanating from within said case except through said aperture.

* * * * *